US005210579A

United States Patent [19]

Setoriyama et al.

[11] Patent Number: 5,210,579

[45] Date of Patent: May 11, 1993

[54] IMAGE FIXING APPARATUS HAVING A PARTING RESIN LAYER FOR REDUCING FRICTIONAL RESISTANCE OF THE FILM THROUGH WHICH THE IMAGE IS HEATED

[75] Inventors: Takeshi Setoriyama; Akira Kuroda, both of Tokyo, Japan

[73] Assignee: Canon Kabushiki Kaisha, Tokyo, Japan

[21] Appl. No.: 798,546

[22] Filed: Nov. 26, 1991

[30] Foreign Application Priority Data

Nov. 30, 1990 [JP] Japan ..... 2-339896
Nov. 30, 1990 [JP] Japan ..... 2-339899
Jul. 10, 1991 [JP] Japan ..... 3-170073

[51] Int. Cl.[5] ..... G03G 15/20

[52] U.S. Cl. ..... 355/285; 219/216; 355/290

[58] Field of Search ..... 355/282, 285, 289, 290, 355/295, 284; 219/216; 432/59, 60

[56] References Cited

U.S. PATENT DOCUMENTS 3,811,828 5/1974 Ohta et al. ..... 219/216 X
4,954,845 9/1990 Yano et al. ..... 355/290
4,998,121 3/1991 Koh et al. ..... 355/285
5,026,276 6/1991 Hirabayashi et al. ..... 432/59
5,027,160 6/1991 Okada et al. ..... 355/282
5,043,763 8/1991 Koh et al. ..... 355/285 X
5,083,168 1/1992 Kusaka et al. ..... 355/285

FOREIGN PATENT DOCUMENTS 0018747 2/1979 Japan ..... 355/285
0090180 5/1986 Japan ..... 355/290
0093476 5/1986 Japan ..... 355/290
0285378 11/1990 Japan ..... 355/285
2027640 2/1980 United Kingdom ..... 355/295

*Primary Examiner*—A. T. Grimley
*Assistant Examiner*—William J. Royer
*Attorney, Agent, or Firm*—Fitzpatrick, Cella, Harper & Scinto

[57] ABSTRACT

An image heating apparatus includes a heater; a film slidably contactable to the heater; a back-up rotatable member cooperative with the heater to form a nip therebetween with the film therebetween; a driver for driving the back-up rotatable member; wherein the film is driven only by a driving force of the back-up rotatable member; and a resin layer having a parting property, on a portion of the heater which is slidably contactable to the film.

19 Claims, 12 Drawing Sheets

IMAGE FIXING APPARATUS HAVING A PARTING RESIN LAYER FOR REDUCING FRICTIONAL RESISTANCE OF THE FILM THROUGH WHICH THE IMAGE IS HEATED

FIELD OF THE INVENTION AND RELATED ART

The present invention relates to an image heating apparatus for heating images on a recording material through a film to fix the image thereon or to improve the surface property of the image.

In a widely used image heating apparatus for heat-fixing images, use is made with a heating roller maintained at a predetermined temperature and a pressing roller having an elastic layer and press-contacted to the heating roller, to form a nip therebetween through which the recording material is passed.

Another type of heating apparatus has been proposed in U.S. Pat. Nos. 4,954,845, 4,998,121 or U.S. Ser. No. 560,760 which have been assigned to the assignee of this application. It uses a thin film.

Referring first to FIG. 10, there is shown an example of an image heating (fixing) apparatus of this type which uses a heat-resistive endless film. This apparatus comprises the heat-resistive endless belt 52 (fixing film or film). It is stretched around parallel three members, i.e., a left driving roller 51, a right follower roller 53 and a low thermal capacity linear heater 19 disposed at a lower portion between the driving roller 52 and the follower roller 53.

When the driving roller 52 rotates in the clockwise direction, the fixing film 51 rotates in the clockwise direction at a predetermined peripheral speed, that is substantially the same peripheral speed of the recording sheet P (process speed), the recording sheet P carrying an unfixed toner image Ta on a top surface thereof and being fed from an unshown image forming station.

A pressing member 55 is in the form of a pressing roller and is press-contacted to the bottom surface of the heater by an unshown urging means with the bottom travel of the fixing film 51 between the heater 19 and the pressing roller 55 it rotates in the counterclockwise direction so as to provide peripheral movement in the direction same as the movement of the recording sheet P.

The heater 19 is a low thermal capacity linear heater extending in a direction crossing with the movement direction of the film 51 (substantially along the width direction of the film). It comprises a heater base 19*a*, a heat generating element (a resistor producing heat upon electric power supply thereto) 19*b*. It is fixedly supported on a supporting member 80 by way of a heat insulating member 20.

The recording material sheet P having the unfixed toner image Ta on its top face, fed from the image forming station, is guided by a guide 81 and enters the nip N between the heater 19 and the pressing roller 55, more particularly, between the fixing film 51 and the pressing roller 55. It passes through the nip while the unfixed toner image bearing surface is in contact, with relative movement, with the bottom surface of the fixing film 51 rotating at the same peripheral speed as the speed of the recording sheet P.

The heater 19 is supplied with electric power at predetermined timing, and the thermal energy is transferred from the heater 19 through the film 51 to the recording sheet P in contact with the film, by which the toner image Ta is softened and fused into an image Tb by the heat applied during passage through the nip N.

The fixing film 51 rotated is deflected in its traveling direction at an acute angle $\theta$ at an edge S of the insulating member 20 which has a large curvature. Therefore, the recording sheet P having passed through the nip N with the fixing film 51, is separated by the curvature from the fixing film 51 at the edge S, and is discharged. Until the sheet reaches the discharging portion, the toner is sufficiently cooled and solidified, and is completely fixed on the recording sheet P as a fixed image Tc.

FIG. 11 shows another example in which the fixing film is non-endless, and is stretched between a supply shaft 82 and a take-up shaft 83.

In the heating apparatus of the film heating type, it is desirable that the heat resistive film and the recording material are moved in close contact with each other and with relative movement therebetween. If slippage occur therebetween, the image on the recording material in contact with the heat resistive film is disturbed.

It is also desirable that the resistance against the sliding movement between the heater and the heat resistive film is made as small as possible to reduce the driving torque, since then the structure for the driving system is simplified, so that the size, cost and the required energy or the like can be totally reduced.

SUMMARY OF THE INVENTION

Accordingly, it is a principal object of the present invention to provide an image heating apparatus wherein the film does not slip so as to provide stabilized movement.

It is another object of the present invention to provide an image heating apparatus in which the driving torque for the film is reduced.

It is a further object of the present invention to provide an image heating apparatus in which the sliding part of the heater is coated with a parting resin.

It is a yet further object of the present invention to provide an image heating apparatus in which the sliding part of a film guide is made of parting resin.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
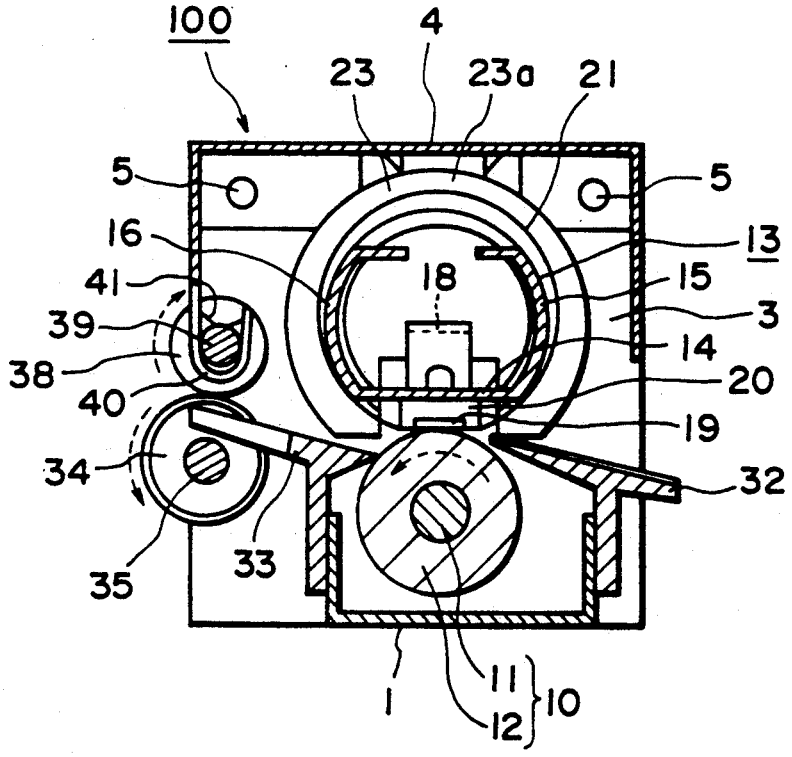
FIG. 1 is a sectional view of an apparatus according to an embodiment of the present invention.
Figure 2:
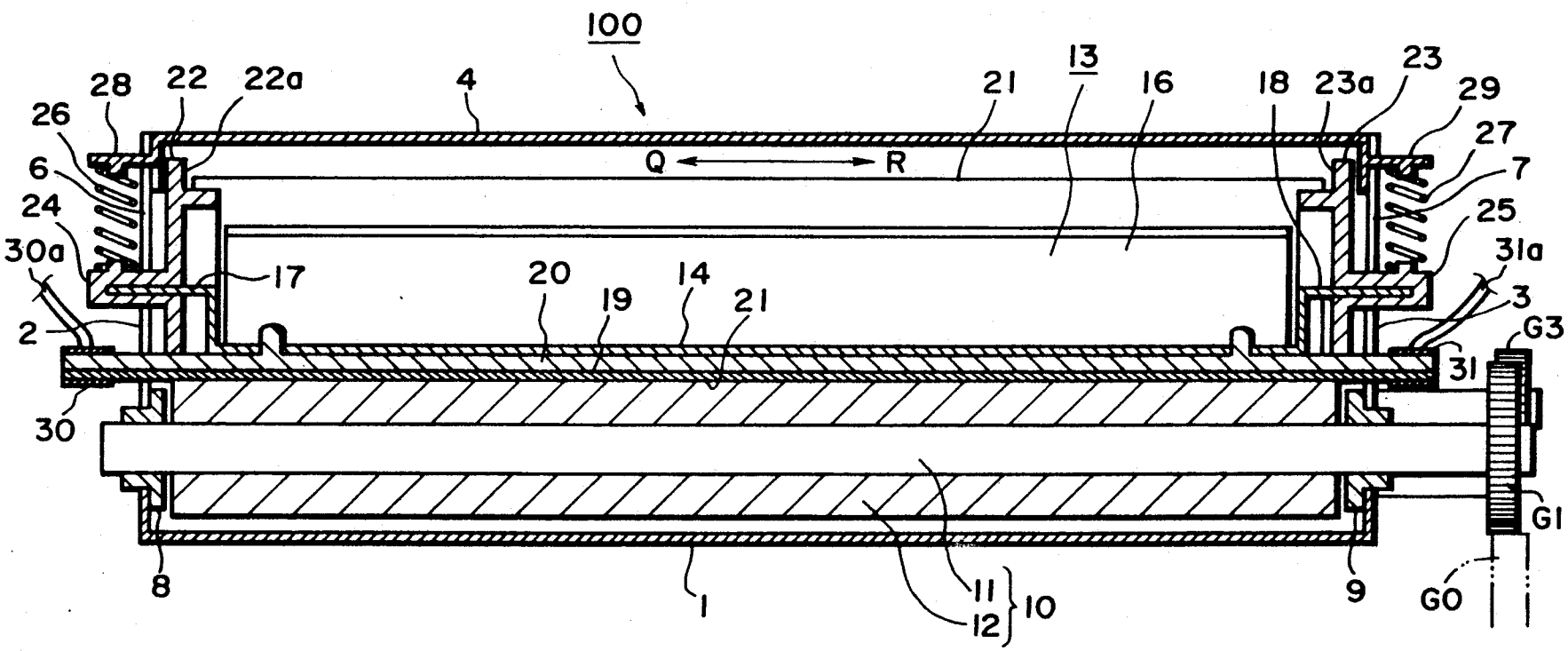
FIG. 2 is a longitudinal sectional view of the apparatus of FIG. 1.
Figure 3:
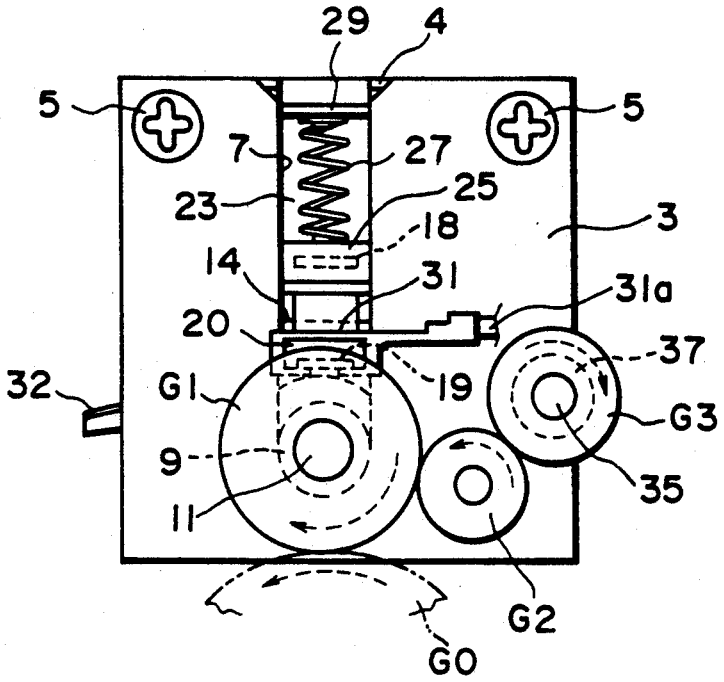
FIG. 3 is a right side view of the apparatus of FIG. 1.
Figure 4:
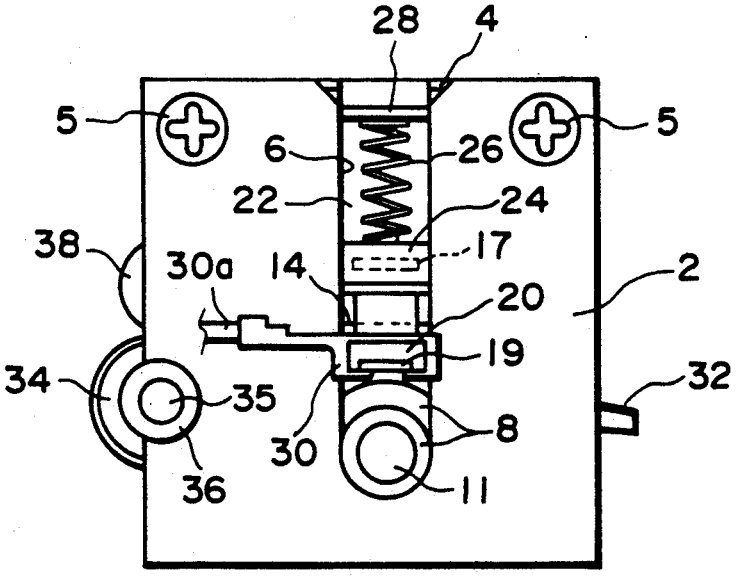
FIG. 4 is a left side view of the apparatus of FIG. 1.
Figure 5:
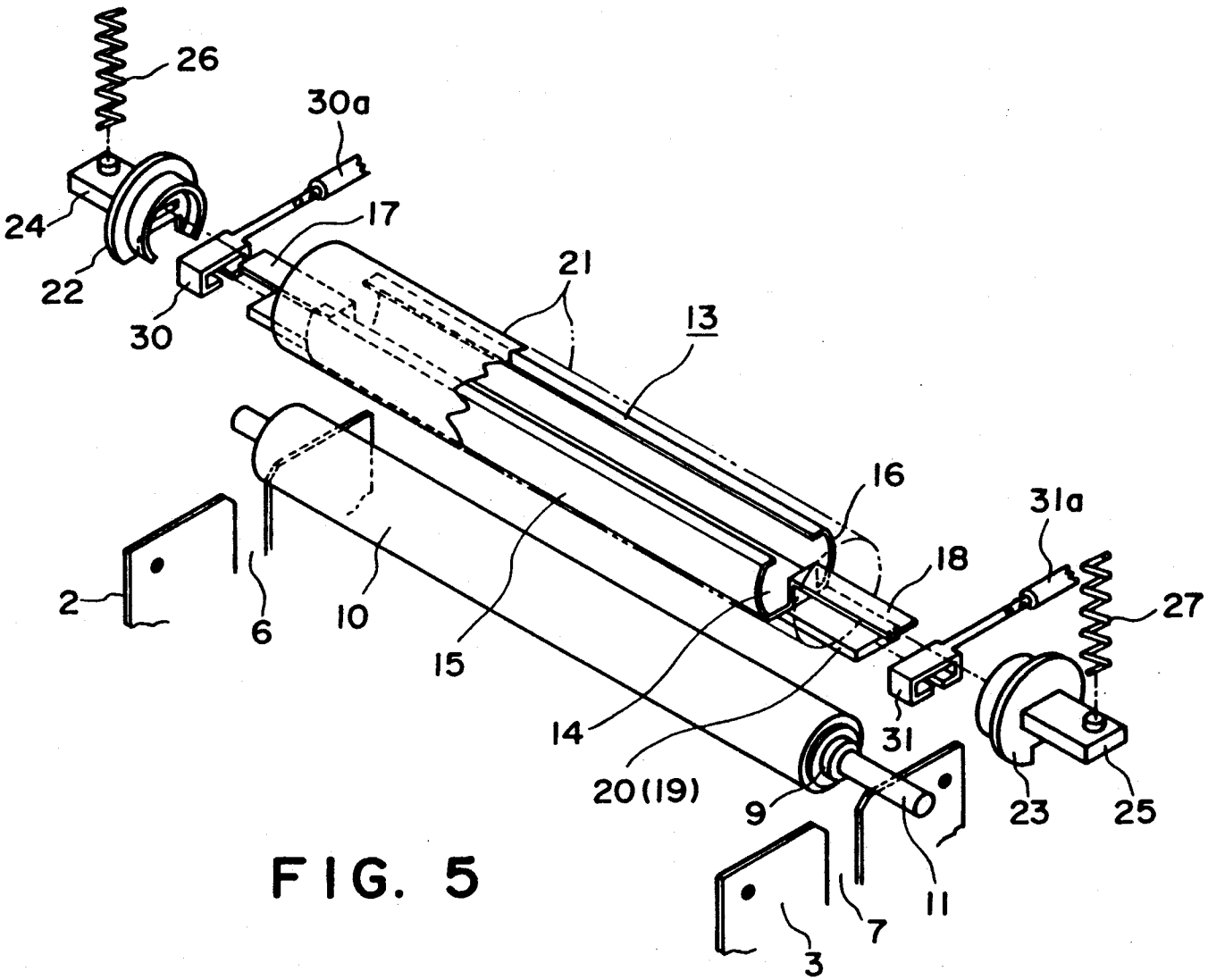
FIG. 5 is an exploded perspective view of the apparatus of FIG. 1.

FIG. 1 shows an image heating apparatus 100 according to an embodiment of the present invention. This is used for fixing an image in this embodiment. FIGS. 2, 3, 4 and 5 are a longitudinal sectional view, a right side view, a left side view and a partial exploded perspective view of the apparatus of FIG. 1.

It comprises an elongated frame (bottom plate) in the form of a channel opening upwardly. It is made of metal plate. It further comprises a left and right wall plates 2 and 3 integral with the frame 1 at the left and right ends thereof, a top cover 4 which is securedly fixed on the left and right wall plates 2 and 3 by screws 5. It is removable by unthreading the screws 5.

Elongated slots 6 and 7 are formed substantially in the middle of the wall plates 2 and 3 in alignment with each other. Bearings 8 and 9 constituting a pair are received by the slots 6 and 7 at their bottoms, respectively.

A film pressing roller (back-up roller) 10 is cooperative with a heater which will be described hereinafter to form a nip with a film therebetween to drive the film. It comprises a central shaft 11, a roller portion 12 made of rubber elastic material having a good parting property, such as silicone rubber or the like on the shaft The left and right ends of the central shaft 11 are rotatably supported by the bearings 8 and 9.

An elongated stay 13 is made of metal plate and functions as an inside guiding member for the film 21 which will be described hereinafter and also functions as a supporting and reinforcing member for the heater 19 and an insulating member 20 which will be described hereinafter.

The stay 13 comprises a flat bottom 14, arcuated front and rear walls 15 and 16 extended long sides of the bottom 14, and lags 17 and 18 outwardly extended from the left and right ends of the bottom 14, respectively.

Designated by a reference 19 is a low thermal capacity heater which will be described in detail hereinafter, and extends in a direction crossing with the movement direction of the film, particularly the direction perpendicular thereto.

The heater 19 is mounted on an insulating member 20, and the insulating member 20 is extended in parallel with the bottom surface of the elongated bottom 14 of the stay 13, with the heater 19 side facing down.

The film 21 is in the form of an endless heat-resistive film and extends around the outside of the stay 13 including the heater 19 and the insulating member 20. The internal circumferential length of the heat resistive film 21 is larger than the outer circumferential length of the stay 13 including the heater 19 and the insulating member 20 by 3 mm, for example. Therefore, the film 21 is loosely extended around the assembly including the heater 19, the insulating member 20 and the stay 13.

Film end confining members 22 and 23 constituting a pair are mounted on the respective lags 17 and 18 of the stay 13.

The distance between the inside surfaces 22*a* and 23*a* of the flanges 22 and 23 is slightly larger than the width of the film 21.

Lags 24 and 25 are horizontally extended outwardly from the flanges 22 and 23, respectively. The horizontal lags 17 and 18 extending form the stay 13 is securedly fixed in the thickness of the lags 24 and 25, respectively, so that the flanges 22 and 23 are securedly supported.

In the assembling of the apparatus, the top cover 4 is not mounted on the wall plates 2 and 3. The pressing roller 10 with the bearings 8 and 9 is inserted into the elongated slots 6 and 7 of the wall plates 2 and 3 from the top open ends thereof so that the bearings 8 and 9 are received by the bottoms of the slots 6 and 7 (falling type).

Then, a sub-assembly comprising the stay 13, the heater 19, the insulating member 20, the film 21 and the flanges 22 and 23 which are assembled in the relation shown in the Figure, is inserted into the slots 6 and 7, while the heater 19 faces down, so that the outward projections of the insulating member 20 and the lags 24 and 25 of the flanges 22 and 23 are inserted into the slots 6 and 7, respectively, until the facing down heater 19 is received by the top surface of the pressing roller 10 with the film 21 therebetween (falling type).

Thus, lags 24 and 25 of the flanges 22 and 23 are projected through the slots 6 and 7 outwardly of the wall plates 2 and 3. Coil springs 26 and 27 are set on the lags 24 and 25 so as to be positioned by projections formed on the top surface of the lags 24 and 25. The top cover 4 is then mounted on the wall plates 2 and 3 by screws 5 at the tops of the wall plates 2 and 3. At this time, the outward lags 28 and 29 of the top cover 4 compress the coil spring 26 and 27 at the tops thereof, so that the coil springs 26 and 27 are compressed between the lags 24 and 28 and between the lags 25 and 29, respectively. By doing so, the coil springs 26 and 27 function to downwardly urge the entire assembly comprising the stay 13, the heater 19, the insulating member 20, the film 21 and the flanges 22 and 23, so that the heater 19 and the pressing roller 10 are pressed each other with the film 21 therebetween with substantially the uniform pressure along the length thereof, at the total pressure of 4 7 kg, for example.

Connectors 30 and 31 are mounted at the opposite ends of the insulating member 20 extending through the elongated slots 6 and 7 outwardly from the side wall plates 2 and 3. The connectors are used for supplying electric power to the heater 19.

An inlet guide 32 functions to guide the member to be heated and is mounted on the front wall of the apparatus frame 1. It is effective to direct the recording material sheet P (FIG. 7) carrying a visualized image (powdery toner image) Ta which is a member to be heated in this example, into a nip between the film 21 and the pressing roller 10 in the nip N (heat fixing position) provided by the heater 19 and the pressing roller 10 pressed thereto with the film 21 therebetween.

An outlet guide (separation guide) 33 is mounted on the rear wall of the frame 1 and functions to guide the recording sheet having passed through the nip, into a nip formed between a lower discharging roller 34 and an upper pinch roller 38.

The discharging roller 34 has its shaft 35 having left and right end portions rotatably supported by bearings 36 and 37 on the wall plates 2 and 3. The pinch roller 38 has a shaft 39 which is received by a hook 40 formed by inwardly bending a part of the rear wall of the top cover 4, and it is contacted to the top surface of the discharging roller 34 by the weight thereof and by the function of a pressing spring 41. The pinch roller 38 rotates following rotation of the discharging roller 34.

A first gear G1 is fixed on the right end of the roller shaft 11 outwardly extended beyond the right side wall plate 3. A third gear G3 is securedly fixed on the right end of the discharging roller shaft 35 extended outwardly beyond the right side wall plate 3. A second gear G2 functions as a relaying gear and rotatably mounted on the outer surface of the right wall plate 3, and is meshed with the first gear G1 and the third gear G3.

The first gear G1 receives the driving force from a driving gear G0 of an unshown driving source mechanism so as to rotate the pressing roller 10 in the counterclockwise direction in FIG. 1. Then, the first gear G1 transmits the rotational force through the second gear G2 to the third gear G3, so that the discharging roller 34 rotates also in the counterclockwise direction in FIG. 1.

An image fixing operation of the apparatus of this embodiment will be described.

Figure 6:
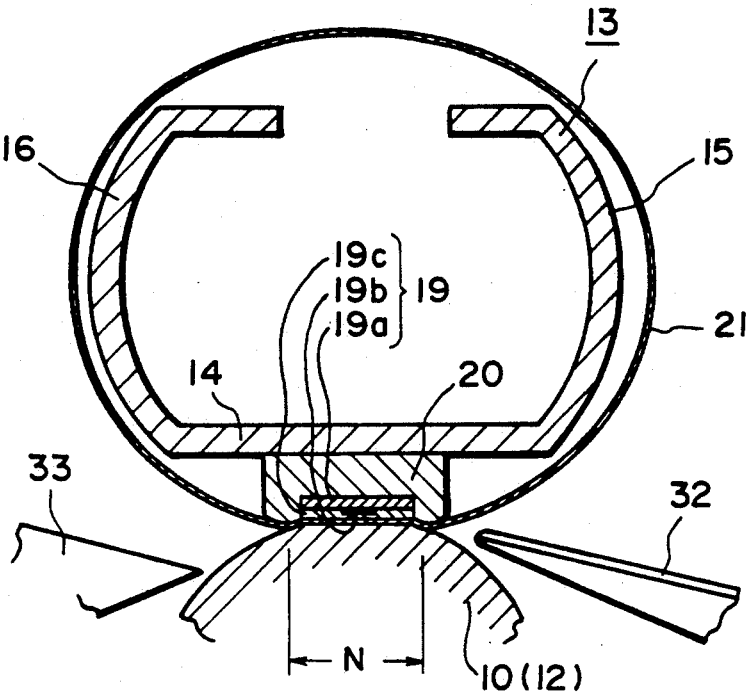
FIG. 6 is an enlarged sectional view of a part of the apparatus of FIG. 1 in which the film is not driven.

When the endless film 21 is not driven, it is tension free in substantially all of its entirety, except for the portion in the nip N between the heater 19 and the pressing roller 10, as will be understood in FIG. 6 which is an enlarged view of a part of the apparatus.

Figure 7:
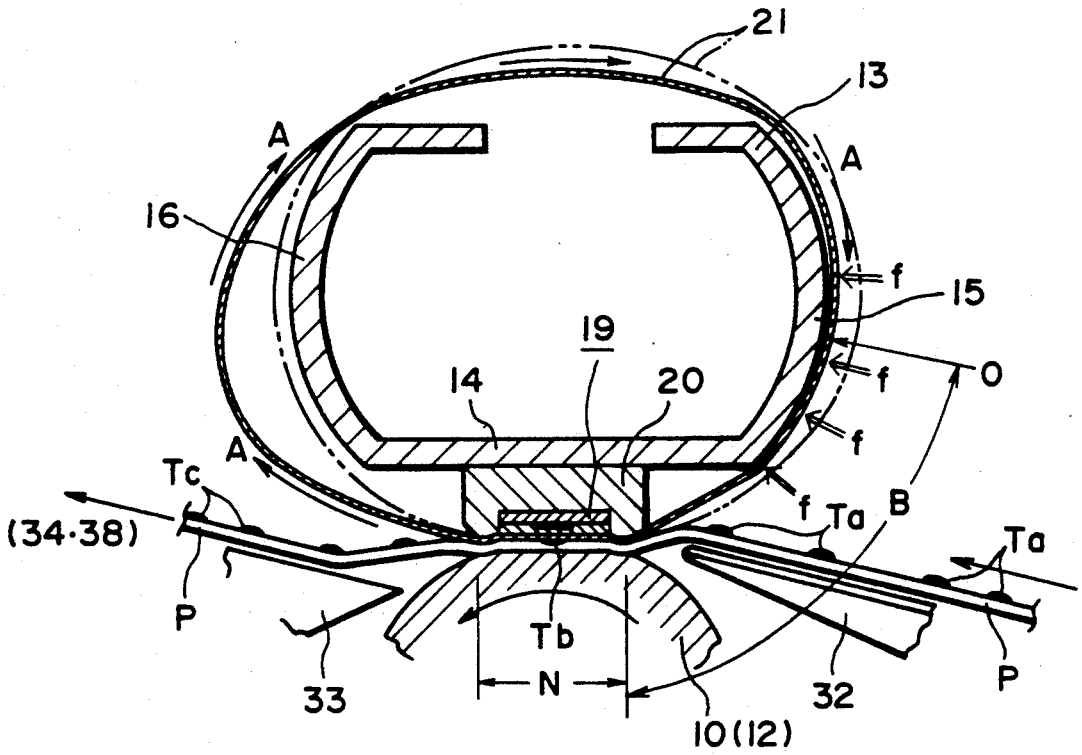
FIG. 7 is a similar view in which the film is driven.

The driving force is transmitted from the driving gear G0 of the driving source mechanism to the first gear G1 by which the pressing roller 10 rotates at the predetermined peripheral speed in the counterclockwise direction in FIG. 7. Then, at the nip N, the film 21 is driven with the aid of the friction between the pressing roller 10 and the film 21, so that the film 21 rotates in the clockwise direction A substantially at the same speed as the peripheral speed of the pressing roller 10 while sliding relative to the heating surface 19.

When the film 21 is driven, that portion of the film which is upstream of the nip N in the direction of the film rotation, receives an attraction force f, the film 21, as shown by the solid line in FIG. 7, rotates in sliding contact with substantially a bottom half of the arcuated front plate 15 functioning as the upstream guide for the inside surface of the film.

As a result, the rotating film 21 is tensioned in the portion B from the contact starting point 0 between the front plate 15 and the film 21 and the downstream nip N, when it is rotated. Therefore, the tension is effective to prevent the production of the crease in the film at the nip N and at the portion B adjacent the recording material inlet for the nip N.

When the film is driven with the heater 19 supplied with the electric power, the recording sheet P carrying an unfixed toner image Ta (element to be heated) is guided to the inlet guide 32 and is introduced into the nip N between the film 21 and the pressing roller 10 with the image bearing surface facing up. The recording sheet P travels in close contact with the surface of the film 21 without relative movement between the film 21 and the recording sheet P, through the nip N. During the travel, the thermal energy is applied to the toner image Ta on the recording material sheet P through the film from the heater 19 contacted to the inside surface of the film at the nip N, so that the toner image Ta is softened and/or fused to an image Tb.

The recording sheet P having passed through the nip N is separated from the film 21 surface while the temperature of the toner is higher than the glass transition point, and is conveyed along the outlet guide 33 into the nip between the discharging roller 34 and the pinch roller 38, so that it is discharged to the outside of the apparatus. The softened and/or fused toner image Tb is cooled enough to be solidified into a solidified image Tc before the recording sheet P discharging the nip N is separated from the film 21 surface and is conveyed to the discharging roller 34.

The recording sheet P introduced into the nip N moves integrally with and in close contact to the tensioned crease free portion of the film, and therefore, there occurs no uneven heating, uneven image fixing, which may occur if the film is creased.

The film 21 is loosely extended around its guiding part, and therefore, only the parts B and N of the entire circumference thereof is tensioned when it is driven and when it is not driven. Accordingly, when the film is not driven (FIG. 6), the film 21 is tension free in almost all of its circumference except for the nip N. It is also tension free when it is driven, except for the nip N and the recording sheet inlet portion to the nip N. In addition, the total circumferential length of the film is relatively small. For these reasons, the driving torque required for the film driving is small, and therefore, the structures of the apparatus, parts and driving system are simplified, and the size and the cost are reduced.

When the film 21 is not driven (FIG. 6), and when the film 21 is driven (FIG. 7), the film 21 is tensioned only at the limited part N or B and N in the entire circumferential length, and therefore, the lateral shifting force toward one lateral side Q (FIG. 2) or the other side R during the film drive is small.

Therefore, even if the film 21 laterally shifts in the direction Q or R to such an extent that the left lateral end abuts the inside surface 22*a* (film confining surface) of the left flange 22, or when the right lateral end thereof abuts the inside surface 23*a* of the right flange 23, the rigidity of the film overcomes the lateral shifting force because the lateral shifting force is small without the damage due to the yielding or the like. Thus, the lateral shift preventing means may be in the form of such a simple structure including the flanges 22 and 23. Therefore, the complication, size and the cost are reduced, and therefore, a reliable apparatus can be constructed at low cost.

The lateral shift confining means may be in the form of a rib or ribs made of heat resistive resin material, formed on the endless film adjacent a lateral end or ends of the film 21 extending in the circumferential direction of the endless film, the rib or ribs being confined.

The reduction of the lateral shifting force may result in reduction of the required rigidity of the film 21, and therefore, thinner film having a lower thermal capacity can be used, and then, the quick start property can be further improved The description will be made as to the film 21 used in this embodiment In order to increase the quick start nature of the apparatus, the thermal capacity of the film 21 is desirably small. From this standpoint, the total thickness T of the film 21 is not more than 100 microns, preferably, not more than 40 microns but is not less than 20 microns. The film may be of a single layer or multi-layer structure having sufficient heat resistivity, parting property, mechanical strength, durability or the like.

For example, it is in the form of a single layer film made of polyimide, polyether imide (PEI), polyether sulfone (PES), tetrafluoroethylene perfluoroalkylvinylether copolymer resin (PFA), polyether ether ketone (PEEK), polyparabanic acid (PPA) or the like, or may be in the form of a multi-layer structure comprising a polyimide film having a thickness of 20 microns which is coated at the image contactable side with PTFE (tetrafluoroethylene resin), PAF, FEP or another fluorinated resin, silicone resin or the like which may be added with conductive member (carbon black, graphite, conductive whisker or the like), as a parting layer which may have a thickness of 10 microns.

The description will be made as to the heater 19 used in this embodiment.

Figure 8A:
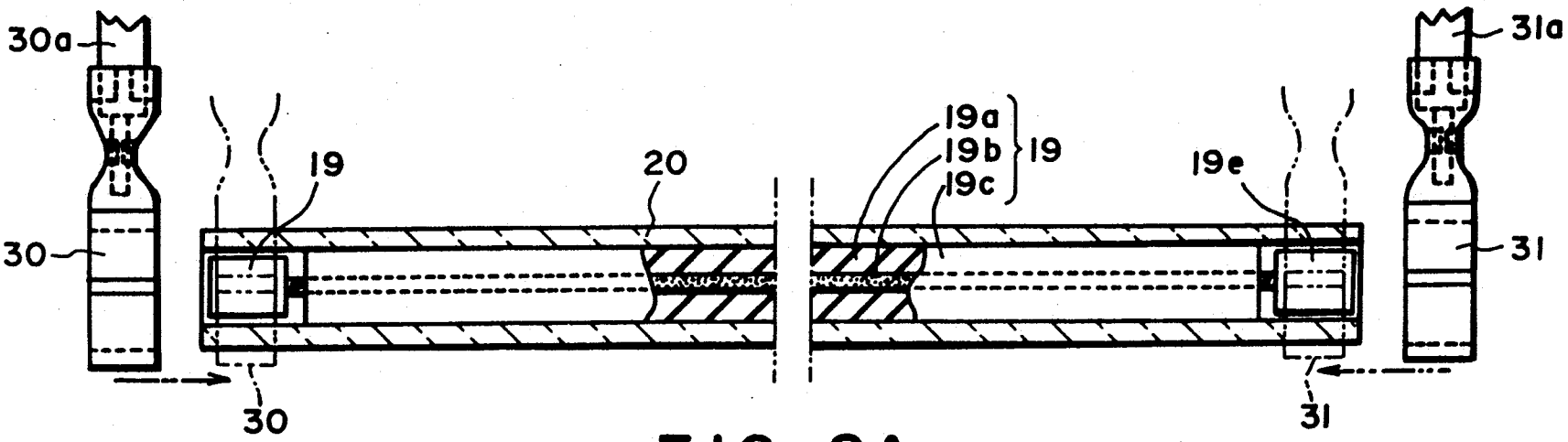
FIG. 8A is a top plan view, at the film side, of the heater mounted on an insulating holder.
Figure 8C:
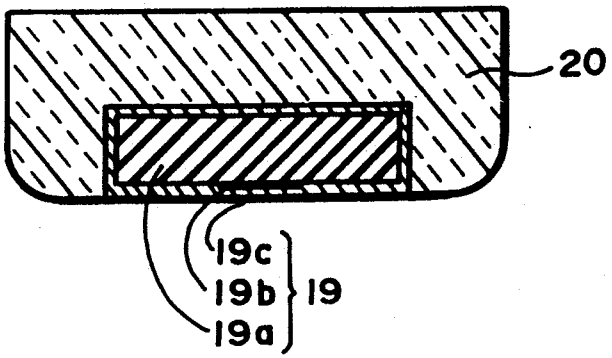
FIG. 8C is an enlarged partial sectional view according to another embodiment of the present invention.
Figure 8B:
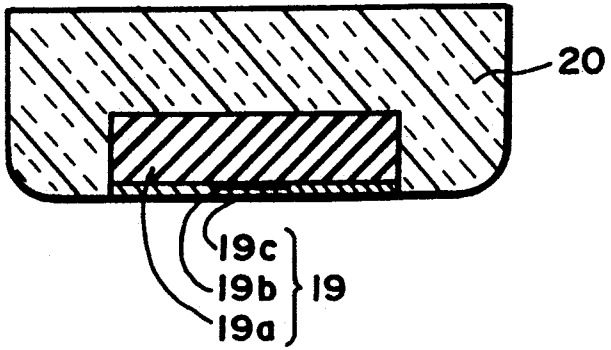
FIG. 8B is a sectional view of the heater mounted on the insulating holder.

Referring to FIG. 8A and 8B, the description will be made as to the heater 19. FIG. 8A is a top plan view of the heater 19 mounted on an insulating holder 20, and FIG. 8B is an enlarged sectional view.

A base 19*a* has heat resistivity, electric insulative nature, low thermal capacity and high thermal conductivity. It is in the form of an alumina (ceramic) base plate having a thickness of 1 mm, a width of 6 mm and a length of 240 mm, for example. A heat generating element 19*b* which generates heat upon electric power supply thereto is provided by screen printing or the like into a linear or a stripe configuration. It is of Ag/Pd (silver palladium), $Ta_2N$, $RuO_2$ or another electric resistance material and has a thickness of approximately 10 microns and a width of 1-3 mm, for example.

First and second power supply electrodes are provided in the form of conductive patterns 19*d* and 19*e* on the surface of the base adjacent the opposite longitudinal ends of the heat generating element 19*b*. The conductive patterns 19*d* and 19*e* are electrically contacted to the respective ends of the heat generating element.

The conductive patterns 19*d* and 19*e* are provided by screen printing or the like. It is made of highly conductive material such as Au (gold), Ag (silver), Cu (copper) or the like.

The surface of the base 19*a* having thereon the heat generating element 19*b* and first and second power supply electrodes 19*d* and 19*e*, is coated with surface protection layer except for the opposite end surfaces having the first and second power supply electrodes 19*c* and 19*d*. The surface protection layer 19*c* is of PFA (tetrafluoroethylene perfluoroalkylvinylether copolymer resin), PTFE (polytetrafluoroethylene resin) or another fluorinated resin. It may be provided by a coating method or sintering method into a thickness of approximately 10 microns.

The heater 19 having the structure described above is mounted on the bottom surface 14 of the elongated stay 13 of metal plate described in the foregoing (supporting member) using an insulating member 20 therebetween, with the surface of the heater 19 faced outside.

When it is mounted, the left and right sides of the insulating member 20 is projected outwardly from the left and right ends of the stay 13, and the projected portions are clamped with the connectors 30 and 31.

The power supply connectors 30 and 31 electrically connected with the first and second power supply electrodes 19*d* and 19*e*, respectively, are electrically connected with a power supply circuit (not shown) through lead wires 30*a* and 31*a*.

Thus, the heater 19*b* is supplied with electric power through a loop constituted by the power supply circuit, the lead 30*a*, the first power supply connector 30, the first electrode 19*d* of the heater 19, the heater 19, the second electrode 19*e*, the second power supply connector 31, the lead 31*a* and the power supply circuit. When the power is supplied in this manner, the heater 19 generates heat.

Although not shown in the Figure, the backside of the heater 19 is provided with a temperature detecting element in the form of a low thermal capacity thermister or Pt film having low thermal capacity or the like, and/or with safety element such as fuse or the like.

At least during the heat-fixing operation, the power supply to the heat generating element 19*b* is controlled so that the thermister or the like detects the predetermined fixing temperature.

The heat generating element 19*b* of the heater 19 is supplied with electric power at predetermined timing in response to the image formation start signal, so that the heat is generated over the entire length of the heat generating element 19*b*. The power is AC 100 V. In response to the temperature detected by the temperature detecting element, the phase angle of the power supply is controlled by a power control circuit (not shown) including triac, so that the power supply is controlled.

Since the total thermal capacity of the base 19*a*, the heat generating element 19*b* and the surface protection layer 19*c* is small, the temperature of the surface of the heater is quickly raised to the predetermined fixing temperature (140°-200° C., for example), in response to the power supply to the heat generating element 19*b*.

The thermal capacity of the heat resistive film 21 contacted to the heater 19 has a small thermal capacity, and the thermal energy is efficiently transmitted to the recording sheet P through the film 21 press contacted thereto, so that the heat-fixing of the image is effected.

As described in the foregoing, the surface temperature of the film opposed to the heater 19 reaches the high temperature which is sufficient to fuse the toner (toner fusing point, or the fixable temperature to the sheet P), and therefore, the quick starting characteristics can be provided Therefore, the necessity for the stand-by temperature control in which the heater 19 is energized beforehand, can be eliminated, by which the energy can be saved, and in addition, the temperature rise in the machine can be prevented.

The insulating member 20 provides insulation for the heater 19 to assist efficient use of the heat generated by the heat generating member 19*b* and is made of heat insulative and highly heat resistive material such as PTS (polyphenylene sulfide), PAI (polyamide imide), PI (polyimide), PEEK (polyether ether ketone), liquid crystal polymer or the like.

At least such a surface of the heater 19 as is slidable with the heat resistive film 21 is coated with surface protection layer 19c made of fluorinated resin or the like having good heat resistive, good slidability and parting property, and therefore, the surface friction coefficient of the heater 19 is small. The friction coefficient $\alpha 1$ between the inside surface of the film and the heater 19 is far smaller than the friction coefficient $\alpha 2$ between the outer surface of the film and the recording material Accordingly, the image heating operation can be performed with stabilized close contact between the film 21 and the image without slippage between the recording material and the film 21, while the film 21 slides on the heater.

The reduction of the frictional coefficient $\alpha 1$ between the heater and the film, reduces the sliding resistance between the heater 19 and the film 21, thus reducing the required driving torque. This permits simple structure of the driving system, the reduction of the size and cost of the apparatus and the energy required for operating the apparatus.

FIG. 8C shows a sectional view of a heater according to another embodiment. A heat generating element 19b is formed on a surface of the heater base 19a. It is inserted into a fluorinated resin tube (having a thickness of approximately 20 microns, for example). The circumferential length of the crosssectional view of the base 19a is smaller than the internal circumferential length of the tube having heat-shrinkable nature. The tube is heat-shrinked in a heating furnace, by which the tube is closely contacted to the outer peripheral surface of the base 19a. By doing so, the sliding surface of the heater 19 relative to the heat resistive film 21 is coated with surface protection layer 19c of fluorinated resin.

However, there is a possibility that fastening force relative to the heat insulative holder decreases, and therefore, it is preferable that only the film side of the heater 19 is coated with the parting resin, as shown in FIG. 8B.

Figure 9:
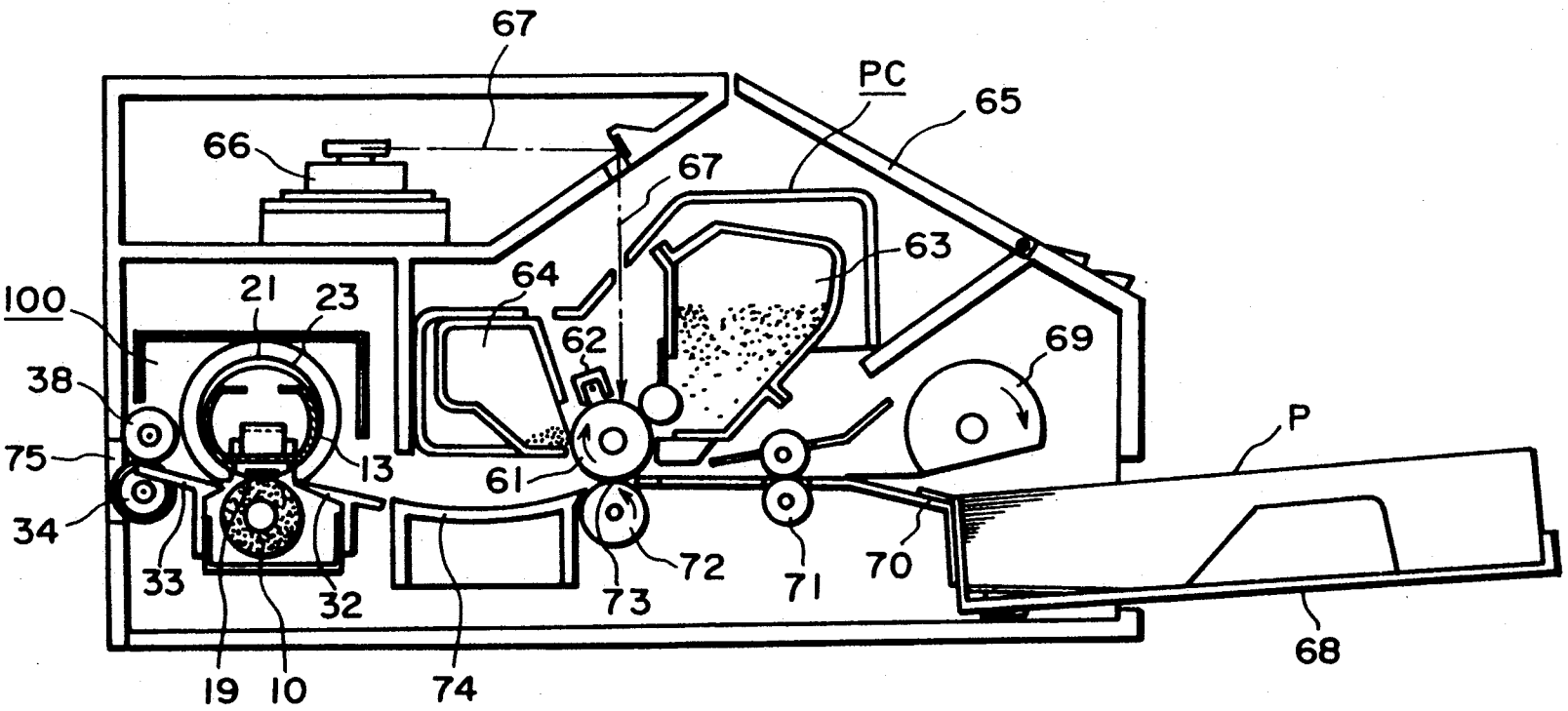
FIG. 9 is a sectional view of an image forming apparatus in which the heating apparatus according to the embodiment of the present invention is used in an image fixing apparatus.
Figure 10:
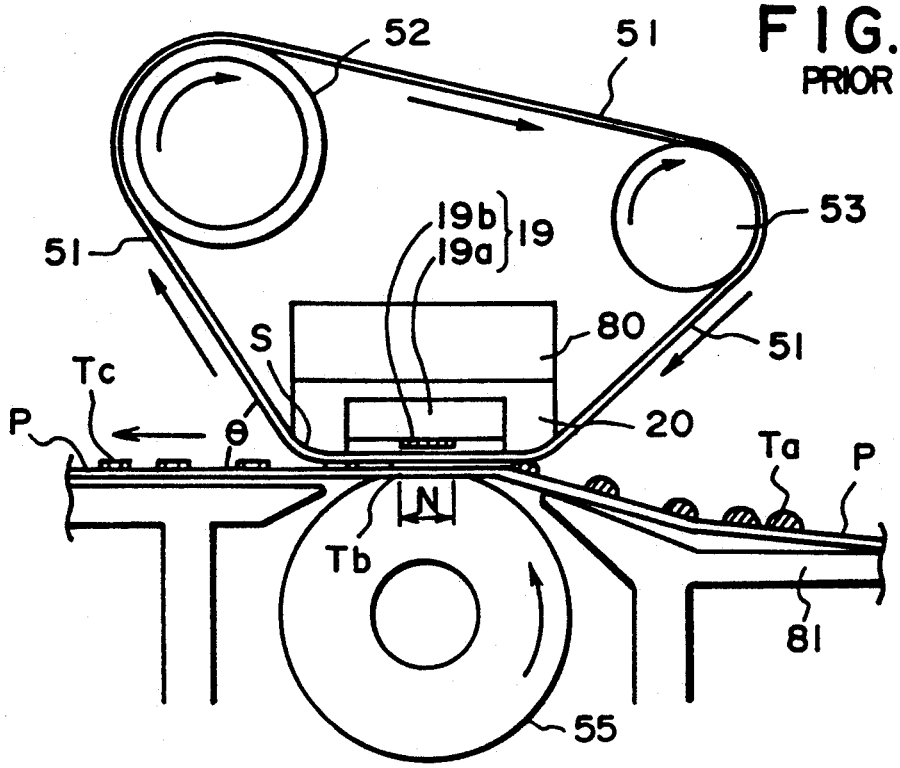
FIG. 10 PRIOR ART
FIGS. 10 and 11 are sectional views of an image heating apparatus as a background of the present invention.
Figure 11:
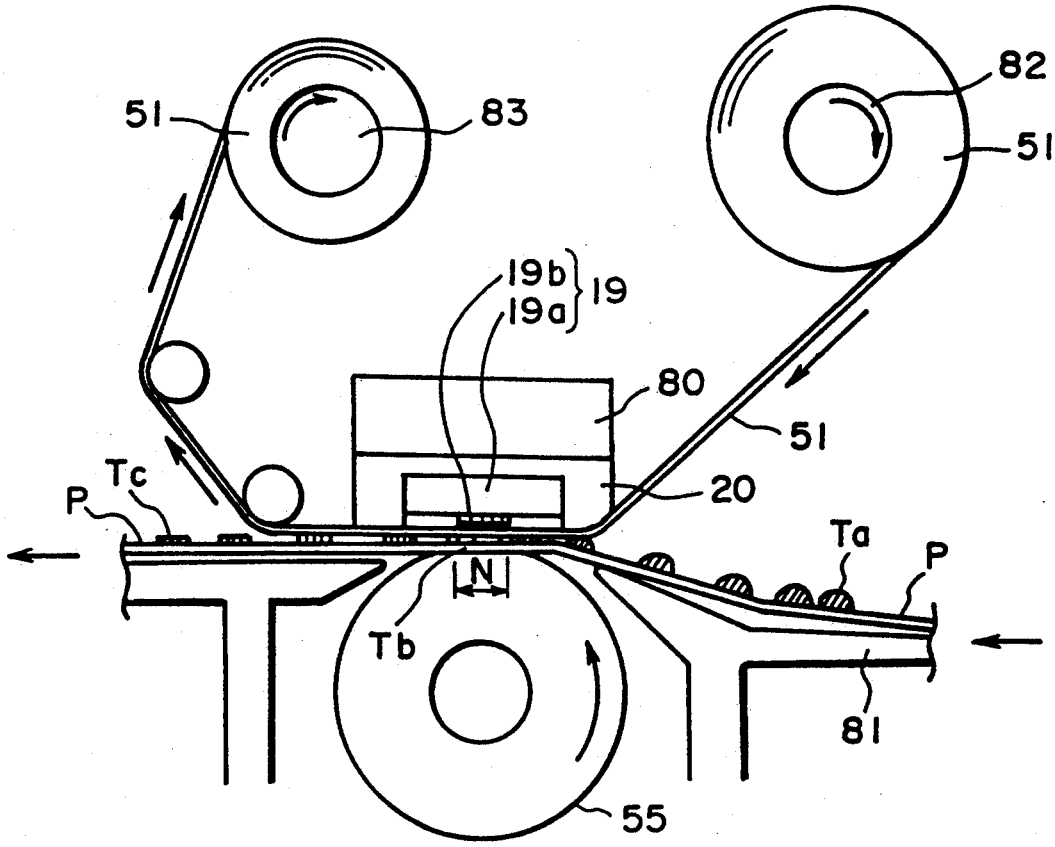
FIG. 11 PRIOR ART

FIG. 9 shows a sectional view of an image forming apparatus incorporating the image heating apparatus of this embodiment as an image fixing apparatus. The image forming apparatus in this example is a laser beam printer of an image transfer electrophotographic process type.

A process cartridge PC comprises an electrophotographic photosensitive member (drum) in the form of a rotatable drum 61, a charger 62, a developing device 63, a cleaning device 64, i.e., four process means. The process cartridge PC is detachably mountable to a predetermined position in the apparatus when the apparatus is opened at the opening portion 65.

In response to an image formation start signal, the drum 61 is rotated in the direction indicated by an arrow, and is uniformly charged to a predetermined polarity and potential by a charger 62. The charged surface of the drum is exposed to and scanned with a laser beam 67 which is produced by a laser scanner 66 and which is modulated in accordance with time series electric digital picture element signal indicative of the desired image information. By doing so, an electrostatic latent image corresponding to the desired image formation is sequentially formed on the surface of the drum. The latent image thus formed is visualized into a toner image by a developing device 63.

On the other hand, a recording sheet P is fed out of the sheet feeding cassette 68 by a pick-up roller 69 and a separating pad 70, one by one. The sheet is fed in timed relation with the rotation of the drum 61 by the registration rollers 71 and fed to an image transfer nip 73 between the drum 61 and an image transfer roller 72 press-contacted thereto The toner image is sequentially transferred from the drum 61 to the recording sheet P surface The recording sheet P having passed through the transfer nip 73 is then separated from the drum 61 and is introduced into the fixing device 100 along a guide 74. The image heating apparatus 100 described hereinbefore fixes the toner image, and the sheet is discharged through the outlet 75 as a print.

The drum 61 having been subjected to the image transfer operation and the recording sheet separating operation is cleaned by the cleaning device 64 so that the residual toner or another contamination is removed therefrom. Then, the drum is prepared for the next image forming operation.

The heating apparatus of this embodiment may be used not only as the image fixing apparatus in an image forming apparatus but also as an image surface improving apparatus for improving the glossiness or the like, or as a preliminary image fixing apparatus.

Figure 12:
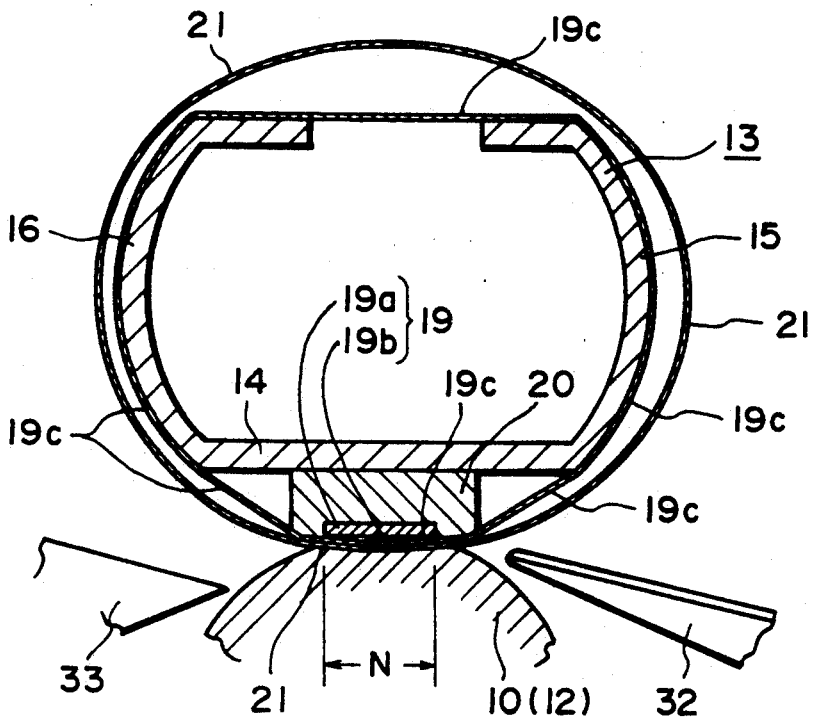
FIG. 12 is a sectional view of the apparatus according to a further embodiment of the present invention in which the film is not driven.
Figure 13:
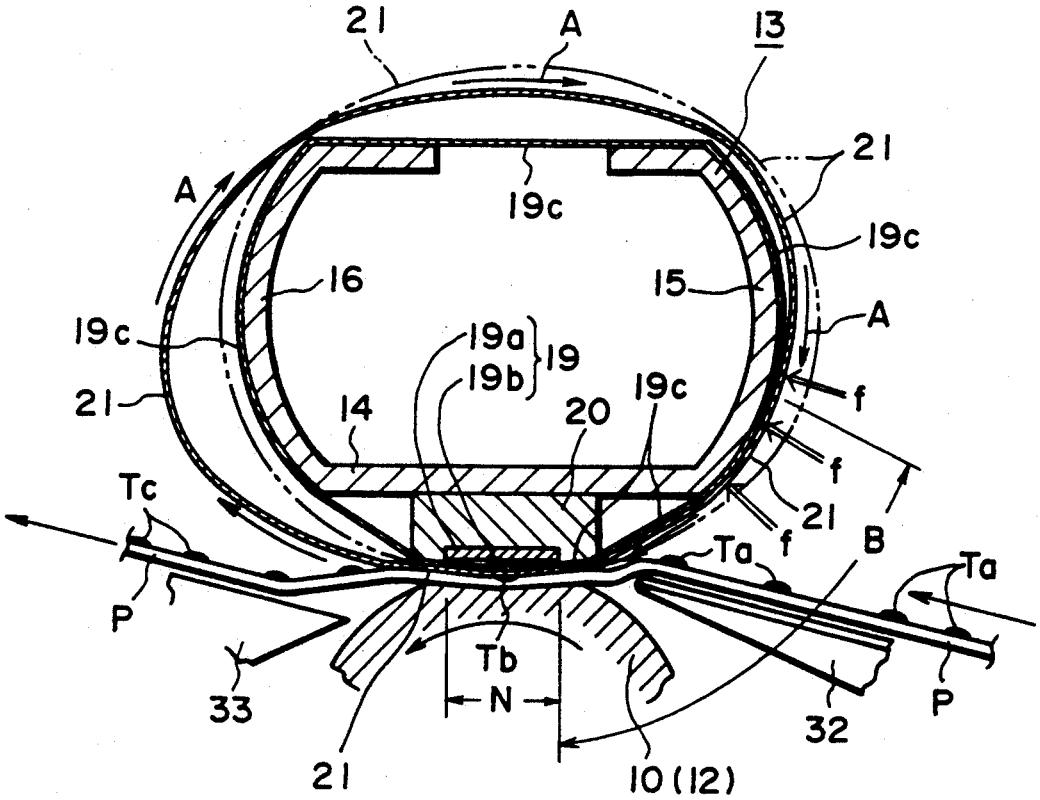
FIG. 13 is a sectional view of the apparatus of FIG. 12 in which the film is driven.
Figure 14:
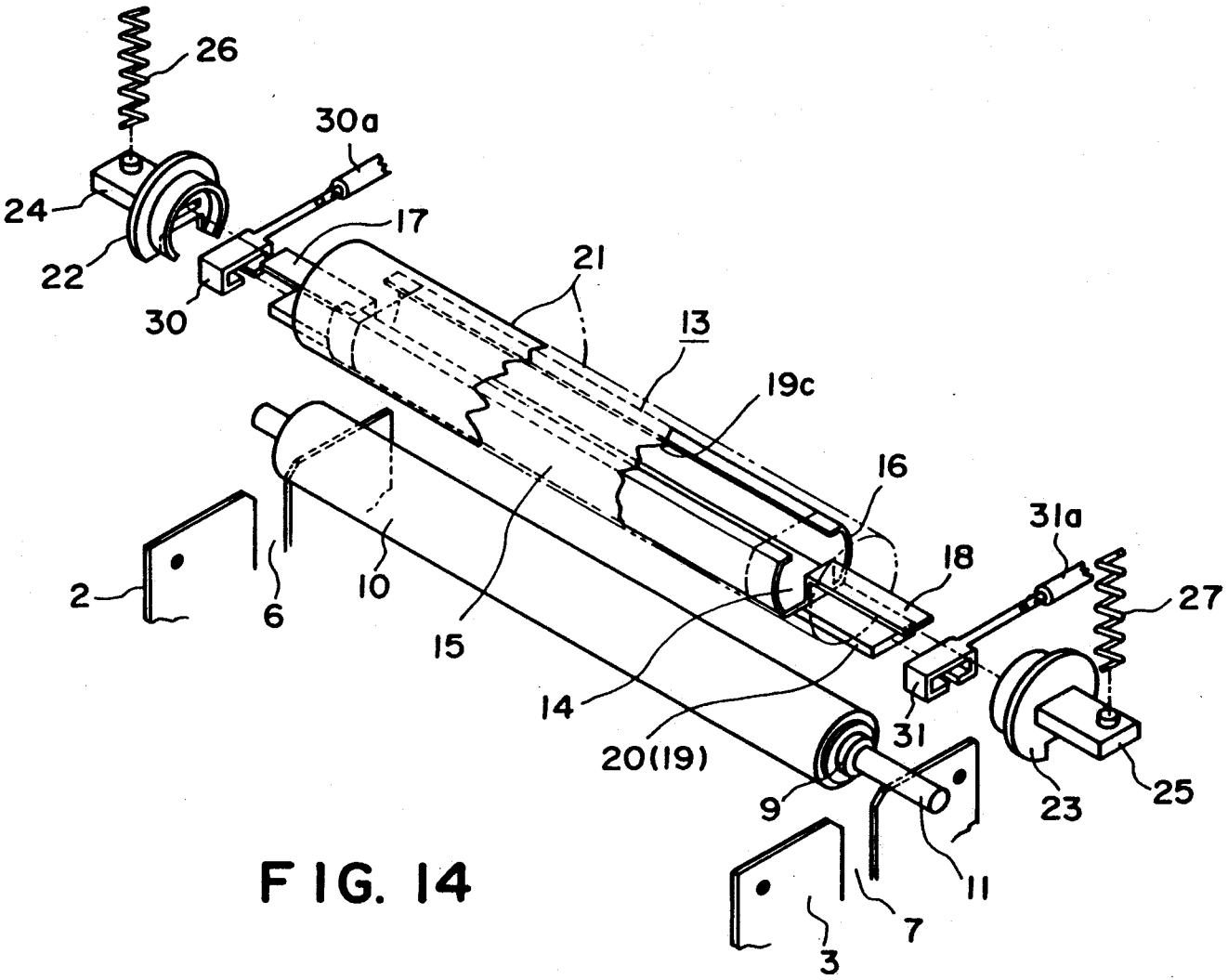
FIG. 14 is an exploded perspective view of a part of the apparatus of FIG. 12.

Referring to FIGS. 12, 13 and 14, a further embodiment will be described. FIG. 12 is an enlarged sectional view when the film is not driven (when the pressing roller does not move); FIG. 13 is an enlarged view when the film is driven (when the pressing roller is driven); and FIG. 14 is an assembling perspective view.

In this embodiment, a sub-assembly is prepared, comprising a stay 13 having a guiding function for guiding the inside surface of the film, an insulating member 20 and a heater 19. The sub-assembly is inserted into a film tube having an inside circumferential length which is slightly later than the outer circumferential length of the sub-assembly. The film is made of heat-resistive resin material having a good sliding nature, such as PFA, FEP or another fluorinated resin. The film has a heat-shrinkable property. Thereafter, the film is heated, by which the film is shrinked to closely contact the outer surface of the sub-assembly (13, 20, 19), as a surface layer 19c. The thickness of the surface layer 19c is 10 microns, for example.

In this embodiment, the surface of the guiding portion contactable with the film is coated with the resin material having the parting nature, and therefore, the travel of the film is further stabilized.

Figure 15:
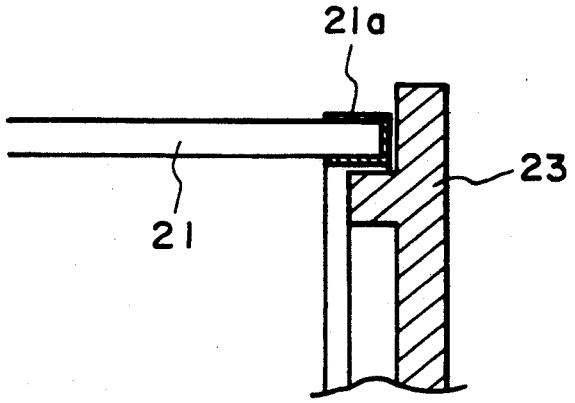
FIG. 15 is a partial enlarged sectional view of the apparatus according to a further embodiment of the present invention.
Figure 16:
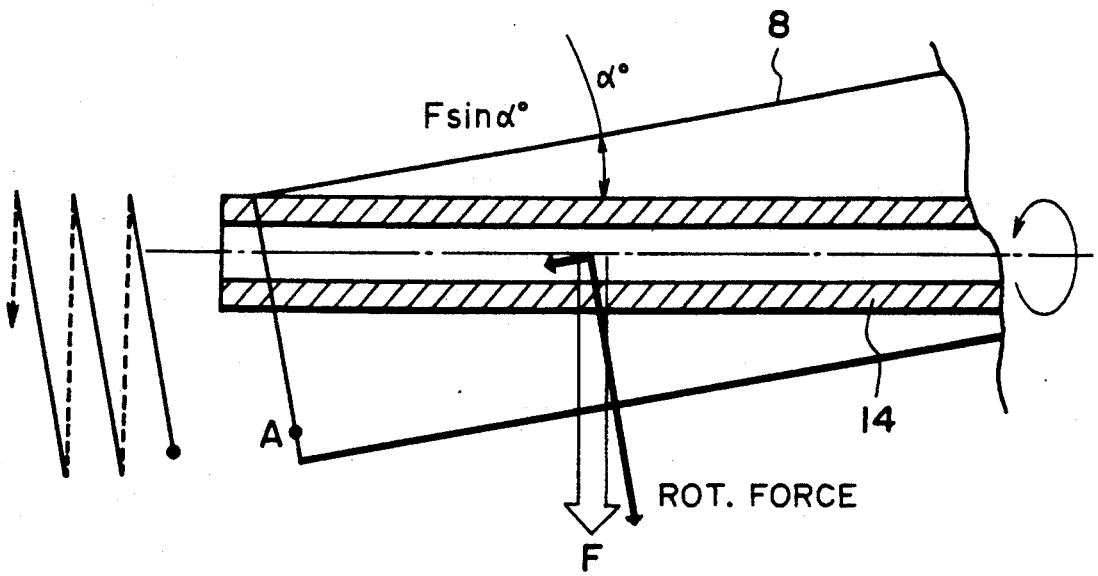
FIG. 16 is a top plan view illustrating lateral shift of the endless film.

Referring to FIG. 15, a further embodiment will be described. In this embodiment, a lateral end of the film 21 is provided with resin coating 21a made of fluorinated resin having a parting property FIG. 16 shows the fixing film which is laterally shifted The lateral shifting of the fixing film results from unavoidable accuracy in the positioning of various members, particularly the heater and the pressing roller, from the non-uniform conveying force along the width of the fixing film due to temperature distribution in the width direction and from unavoidable inaccuracy of the manufacturing of the fixing film (film thickness, cylindricity or the like). The lateral shifting is as shown in FIG. 16, whether the cause of the lateral shifting is one or another of the described above. More particularly, the conveying force non-uniformity resulting from one or more of the above-described causes, inclines the center line of the fixing film by an angle $\alpha$ degree relative to the fixing film guide and the flange. The angle $\alpha$ depends on the difference between the internal circumferential length of the film and the outer circumferential length of the fixing film guide. By the force (friction force) F perpendicular to the direction of the width of the pressing roller, the fixing film is laterally shifted by the force F sign $\alpha$. One point (A) on the circumference of the fixing film end portion travels along a helical path if there is no flange, as shown in FIG. 16. However, because of the provision of the confining flange, it is as if the film rotates perpendicularly to the fixing film guide. However, in the fixing nip in which the film receives the rotational and lateral shifting forces, the lateral end of the fixing film is not influenced by the lateral shifting confinement, and therefore, the path of travel thereof significantly changes adjacent the fixing nip, and therefore, the damage of the lateral end of the fixing film occurs adjacent the fixing nip.

In view of the above, in this embodiment, when the rotating tension free fixing film is confined by the flange at its lateral end, the end is coated with the fluorine resin or the like, and therefore, the damage of the fixing film such as tearing or the like is reduced, thus increasing the service life of the heating apparatus. When the shifted film passes through the fixing nip and is confined by the flange downstream of the fixing nip, the traveling path abruptly changes, and therefore, the fixing film may be damaged. However, since the lateral end of the fixing film is coated with the resin having the good sliding property, and therefore, the damage can be reduced.

Figure 17:
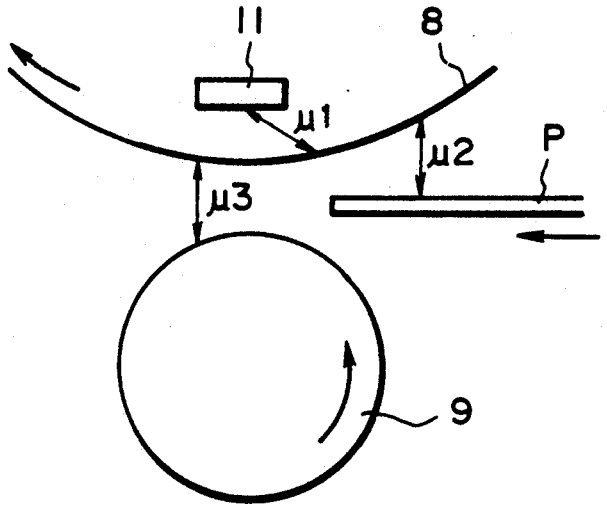
FIG. 17 illustrates the friction in the image heating apparatus.

The frictional coefficients between the tension free fixing film and the various members, are as shown in FIG. 17, that is:

$$f \times \mu 1 < f \times \mu 2$$

where $\mu 1$ is a friction coefficient between the inside surface of the fixing film and the heater, $\mu 2$ is a friction coefficient between the outer surface of the fixing film and the recording material, and f is the force provided by the compression spring 27.

However, when the fixing film is confined at its lateral end or ends, the resistance against the rotation of the fixing film applied by the confining member or members (Fk) satisfies $$f \times \mu 1 + Fk > f \times \mu 2$$

Then, the fixing film does not rotate properly following the recording material during the conveyance of the recording material, that is, the slippage occurs.

The provision of the parting resin material is effective to minimize the resistance Fk against the rotation between the confining flange and the fixing film end, so that even if the film is laterally shifted, the film can be stably driven, that is, the film can be rotated following the pressing roller with the recording material therebetween.

Figure 18:
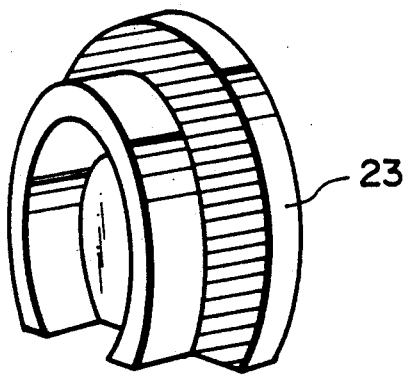
FIG. 18 is a perspective view of a confining flange in an apparatus according to a further embodiment of the present invention.

FIG. 18 shows a perspective view of a confining flange according to a further embodiment of the present invention. In this embodiment, the film confining surface 23*a* of the confining flange is coated with the fluorine resin material If the film thickness of the coating at the end of the fixing film increases, the internal circumferential of the fixing film changes, so that the lateral shifting of the fixing film is influenced However, the amount or thickness of the coating on the confining surface of the confining member does not influence the travel of the fixing film. Therefore, the service life of the heating apparatus can be further improved. The entirety of the regulating flange 23 may be formed of fluorine resin material While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:
a heater;
an endless film slidably contactable to said heater;
a back-up rotatable member cooperative with said heater to form a nip therebetween with said film therebetween;
driving means for driving said back-up rotatable member;
wherein said film is driven only by a driving force of said back-up rotatable member; and
a resin layer, having a parting property, on a portion of said heater which is slidably contactable to said film.

2. An apparatus according to claim 1, wherein said heater is stationary in use.

3. An apparatus according to claim 2, wherein said heater comprises a resistor for generating heat upon electric power supply thereto, and wherein said resin layer covers said resistor.

4. An apparatus according to claim 1, wherein a friction coefficient between the resin layer and said film is smaller than a friction coefficient between said film and a recording material entering the nip.

5. An apparatus according to claim 1, wherein said resin layer is of fluorine resin.

6. An apparatus according to claim 1, wherein said film is in the form of an endless belt loosely extended.

7. An apparatus according to claim 1, wherein a recording material carries an unfixed image, and said heating apparatus fixes the image.

8. An image heating apparatus, comprising:
a heater;
a film movable together with a recording material, said recording material carrying an image which is heated by heat from said heater through said film;
a guide for sliding contact with said film to guide it;
a resin layer having a parting property, at a portion of said guide which is slidably contactable with said film.

9. An apparatus according to claim 8, wherein said guide guides a heater side surface of said film.

10. An apparatus according to claim 8, wherein said film is an endless film, and a lateral shifting of said film is preventing by confining a lateral end of said film by said guide.

11. An apparatus according to claim 8, wherein said heater is stationary in use, and said film is slidably contactable to said heater.

12. An apparatus according to claim 11, wherein a portion of said heater which is slidably contactable to said film is provided with a resin layer having a parting property.

13. An apparatus according to claim 8, further comprising a back-up rotatable member cooperative with said heater to form a nip therebetween with said film therebetween.

14. An apparatus according to claim 13, wherein said back-up rotatable member is driven by driving means, and said film rotates following rotation of said back-up rotatable member.

15. An apparatus according to claim 14, wherein said film is in the form of an endless film, and is driven only by a driving force of said back-up rotatable member.

16. An apparatus according to claim 13, wherein said guide guides a heater side surface of said film, and wherein a frictional coefficient between the resin layer of said guide and said film is smaller than a frictional coefficient between said film and the recording material entering the nip.

17. An apparatus according to claim 8, wherein said resin layer is of fluorine resin.

18. An apparatus according to claim 8, wherein said film is in the form of an endless belt loosely extended.

19. An apparatus according to claim 8, wherein the image is fixed on the recording material by the heat from said heater.

* * * * *

UNITED STATES PATENT AND TRADEMARK OFFICE

CERTIFICATE OF CORRECTION

PATENT NO. : 5,210,579

DATED : May 11, 1993

INVENTOR(S) : TAKESHI SETORIYAMA, ET AL.

It is certified that error appears in the above-indentified patent and that said Letters Patent is hereby corrected as shown below:

COVER PAGE

[75] Inventors line, "Tokyo," should read --Yokohama,--.

COLUMN 2

Line 20, "occur" should read --occurs--.

COLUMN 3

Line 52, "shaft" should read --shaft.--.

Line 63, "16" should read --16,--.

COLUMN 4

Line 24, "form" should read --from--; and "is" should read --are--.

Line 63, "47 kg," should read 4-7 kg,--.

COLUMN 7

Line 9, "embodiment" should read --embodiment.--.

COLUMN 8

Line 7, "is" should read --are--.

Line 15, "heater 19b" should read --heater 19--.

Line 27, "with" should read --with a--; and "as" should read --as a--.

COLUMN 9

Line 11, "material" should read --material.--.

COLUMN 10

Line 7, "thereto" should read --thereto.--.

Line 9, "surface" should read --surface.--.

Line 42, "shrinked" should read --shrunk--.

UNITED STATES PATENT AND TRADEMARK OFFICE

CERTIFICATE OF CORRECTION

PATENT NO. : 5,210,579

DATED : May 11, 1993

INVENTOR(S) : TAKESHI SETORIYAMA, ET AL.

It is certified that error appears in the above-indentified patent and that said Letters Patent is hereby corrected as shown below:

COLUMN 12

Line 2, "material" should read --material.--.

Line 17, "member;" should read --member,--.

Signed and Sealed this

Nineteenth Day of April, 1994

Bruce Lehman

*Attest:*

BRUCE LEHMAN

*Attesting Officer*

*Commissioner of Patents and Trademarks*